US005298152A

United States Patent [19]

Kramer

[11] Patent Number: 5,298,152

[45] Date of Patent: * Mar. 29, 1994

[54] PROCESS TO PREVENT CATALYST DEACTIVATION IN ACTIVATED SLURRY HYDROPROCESSING

[75] Inventor: David C. Kramer, San Anselmo, Calif.

[73] Assignee: Chevron Research and Technology Company, San Francisco, Calif.

[ * ] Notice: The portion of the term of this patent subsequent to Mar. 15, 2011 has been disclaimed.

[21] Appl. No.: 893,219

[22] Filed: Jun. 2, 1992

[51] Int. Cl.[5] ..... C10G 47/26

[52] U.S. Cl. ..... 208/108; 208/143

[58] Field of Search ..... 208/108, 143

[56] References Cited

U.S. PATENT DOCUMENTS 4,557,821 12/1985 Lopez et al. ..... 208/108

4,719,002 1/1988 Mayer et al. ..... 208/108

*Primary Examiner*—R. Bruce Breneman

*Assistant Examiner*—Walter D. Griffin

*Attorney, Agent, or Firm*—W. K. Turner; A. W. Klaassen

[57] ABSTRACT

An improved catalytic slurry hydroprocess comprising a hydrogenation zone having a hydrogen partial pressure of at least about 100 psia characterized by active catalyst recycle accompanied by minimal catalyst deactivation from coking or asphaltene agglomeration in which the improvement comprises the steps of:

1) separating at least a portion of active catalyst from the liquid hydrogenation product eluted from the hydrogenation zone of said hydroprocess, and
2) recycling at least a portion of said separated active catalyst to said hydrogenation zone;

wherein said steps are carried out while maintaining said active catalyst under conditions substantially the same as those encountered in said hydrogenation zone.

13 Claims, 1 Drawing Sheet

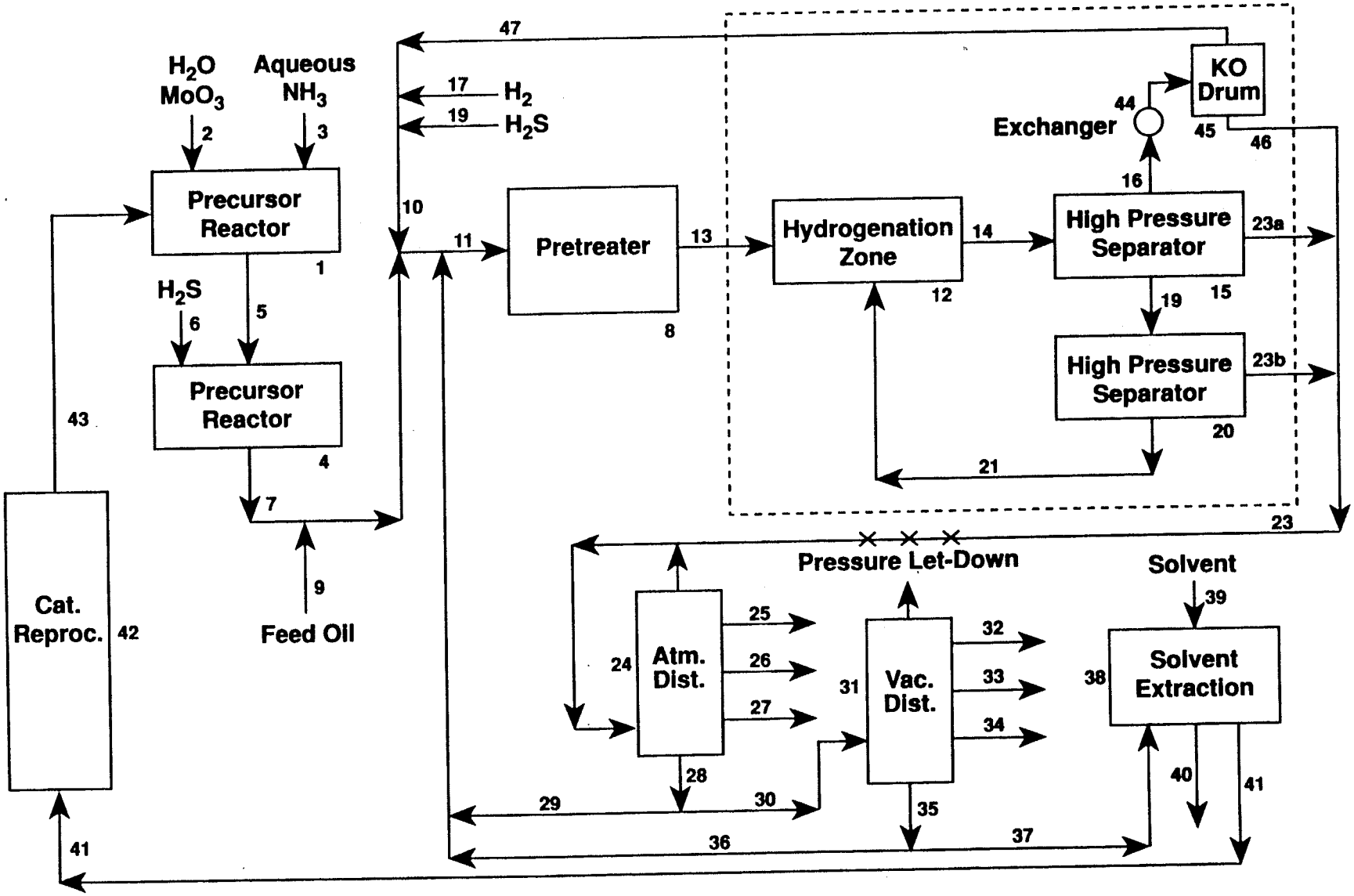
Aqueous $NH_3$
$H_2O$ $MoO_3$
Precursor Reactor
$H_2S$
Precursor Reactor
Feed Oil
Cat. Reproc.
$H_2$
$H_2S$
Pretreater
Hydrogenation Zone
Exchanger
High Pressure Separator
High Pressure Separator
KO Drum
Pressure Let-Down
Atm. Dist.
Vac. Dist.
Solvent
Solvent Extraction

PROCESS TO PREVENT CATALYST DEACTIVATION IN ACTIVATED SLURRY HYDROPROCESSING

BACKGROUND OF THE INVENTION

Field of the Invention

The present invention relates to a process improvement which can be used to prevent deactivation of slurry hydroprocessing catalysts. More particularly, the present invention provides an improvement in slurry hydroprocessing operations, which improvement comprises separating and recycling active catalyst while maintaining the catalyst under conditions which have been found to prevent deactivation caused by coking or asphaltene agglomeration.

Slurry Hydroprocessing

Slurry hydroprocessing operations employing a circulating slurry catalyst are known to those familiar with petroleum processing. In a typical slurry hydroprocessing operation the slurry catalyst consisting of very small particles made up of extremely small crystallites exists as a substantially homogeneous dispersion in an oil or water/oil mixture. A typical slurry catalyst comprises Group VIB metal disulfide which is probably structured molecularly as basal platelets of Group VIB metal atoms separated by two layers of sulfur atoms with activity sites concentrated at the edge of each basal plane of the Group VIB metal atoms.

Such catalysts may be formed by preparing an aqueous slurry of, for example, molybdenum oxide which is in turn reacted with aqueous ammonia and then with hydrogen sulfide in a low temperature, low pressure zone, to produce suspended insoluble ammonium oxysulfide compounds in equilibrium with ammonium molybdenum heptamolybdate in solution. The aqueous equilibrium slurry leaving the zone constitutes a catalyst precursor.

The catalyst precursor is converted into the final catalyst by reaction with hydrogen sulfide and hydrogen in the presence of the feed oil but in advance of the final hydrogenation zone. Typically the aqueous precursor catalyst is mixed with all or a portion of the feed oil stream using the dispersal power of a hydrogen-hydrogen sulfide recycle stream (and make-up stream, if any) and the admixture is passed through a plurality of heating zones prior to the hydrogenation zone.

The small particle size of typical slurry catalysts contributes to the high catalytic activity of slurry catalysts. Typically the catalysts will be sufficiently small to be readily dispersed in a heavy oil, allowing the oil to be easily pumped. In many slurry hydroprocessing operations moderate to large amounts of vanadium and nickel are removed from the feed oil and deposited upon or carried away by the catalyst particles. However, it has been found that these metals do not significantly impair the activity of the catalyst.

Although slurry catalyst hydroprocessing has the advantage of relatively stable high catalytic activity, the costs of fresh catalyst, catalyst separation, and catalyst rejuvenation have a major impact on the economics of such processes. In a typical catalyst separation step, the majority of recovered catalyst is roasted to convert carbon to carbon dioxide and to convert metal sulfides to metal oxides. The roasted catalyst containing molybdenum and nickel as well as vanadium, iron, and nickel removed from the oil is the dissolved in alkali solution from which the individual metals are recovered by selective precipitation. The recovered molybdenum is then processed to make fresh catalyst. A minor portion of recovered catalyst can be recycled to the hydrogenation preheater along with unconverted feed oil. For example U.S. Pat. No. 4,557,821 issued Dec. 10, 1985 and its related patents U.S. Pat. No. 4,710,486 issued Dec. 1, 1987 and U.S. Pat. No. 4,762,812, issued on Aug. 9, 1988 all to Lopez et al. and assigned to the assignee of the present invention describe a process which includes steps for recovering slurry catalyst from a hydroprocessing operation. A variety of separation methods are suggested each involving the formation of a catalyst concentrate. For instance, catalyst can be concentrated in the vacuum bottoms of the product stream via distillation. All, or nearly all, of the catalyst is then recovered by solvent extraction and reprocessed to make fresh catalyst. Optionally, a minor portion of the recovered catalyst is recycled with unconverted feed oil to the hydrogenation preheater without further processing. Unfortunately it has been found that catalysts recycled from the bottoms of the hydrogenation product stream possessed essentially no activity.

Since such catalyst separation, recovery, and recycle steps are expensive and result in deactivated catalyst, it has been the focus of recent slurry hydroprocessing research to maximize the residence time of catalyst in the hydrogenation zone. This allows one to enhance product properties at a given fresh catalyst concentration or to reduce the amount of fresh catalyst necessary to achieve given product properties. However, at this time no reliable method has been reported for selectively increasing the residence time of the slurry catalyst in the hydrogenation zone. Accordingly, as an alternative approach, if active catalyst could be separated and recycled, capital and operating expenses would be greatly reduced. It is the principal object of the present invention to provide a process for recycling active catalyst in a slurry hydroprocessing operation. This object, and other objects, are accomplished by the improved process which is summarized below.

SUMMARY OF THE INVENTION

In accordance with the present invention, a process for recycling active catalyst in a slurry hydroprocessing operation is provided. The essence of the present invention resides in the discovery that catalyst deactivation does not rapidly occur during hydrogenation. In fact, coking or asphaltene agglomeration which occurs when catalyst is separated from the hydrogenation products is a significant cause of catalyst deactivation. It has been found that deactivation occurs when the catalyst is removed from a reducing atmosphere as the operating pressure of the process is let down to facilitate catalyst separation. That is, it has been discovered that in conventional slurry hydroprocessing operations, when catalyst is withdrawn from a high pressure hydrogen atmosphere, coking and asphaltene agglomeration rapidly deactivate the catalyst. By separating and recycling active catalyst under substantially the same conditions encountered in the hydrogenation zone the process of the present invention overcomes this problem. This discovery has led to the present invention which provides an improved catalytic slurry hydroprocess comprising a hydrogenation zone having a hydrogen partial pressure of at least about 100 pounds per square inch absolute ("psia") in which the improvement comprises the steps of:

(1) separating at least a portion of active catalyst from the liquid hydrogenation product eluted from the hydrogenation zone of said hydroprocess, and (2) recycling at least a portion of said separated active catalyst to said hydrogenation zone;

wherein said steps are carried out while maintaining said active catalyst under conditions substantially the same as those encountered in said hydrogenation zone.

In a preferred embodiment active catalyst is recycled before it leaves the hydrogen loop of the hydroprocessing operation. For example, active catalyst may be recycled directly from a high pressure separator. In a particularly preferred embodiment a high pressure separator also acts as a high pressure settler. Concentrating the active catalyst by settling reduces the amount of liquid product needed to recycle the catalyst. Maximizing the separator temperature minimizes the amount of valuable light hydrocarbons in the recycle stream. The preferred embodiment summarized above is illustrated in the accompanying FIGURE.

BRIEF DESCRIPTION OF THE FIGURE

The accompanying FIGURE illustrates a preferred embodiment of the improved process claimed below. The FIGURE is a schematic representation of a slurry hydroprocessing operation in which catalyst is recycled from the high pressure loop.

DETAILED DESCRIPTION OF THE INVENTION

The full scope of the improved process of the present invention will be apparent to those familiar with slurry hydroprocessing from the following detailed description of the principal features of the improvement steps and from the example which accompanies the description.

Principal Features

The present invention provides an improvement to slurry hydroprocessing operations. The principal features of the improvement arise out of the discovery that when recovering catalyst from slurry hydroprocessing operations, the catalyst undergoes rapid deactivation as coke and/or asphaltenes agglomerate on the catalytic sites when catalyst is withdrawn from the hydrogenation zone as the operating pressure is reduced to facilitate recovery. To overcome this problem, according to the present invention, slurry hydroprocessing operations can be improved by (1) separating and (2) recycling active catalyst while maintaining said catalyst under conditions substantially the same as the conditions encountered in the hydrogenation zone of said slurry hydroprocessing operations.

In the first step of the improved process of the present invention at least a portion of active catalyst is separated from hydrogenation product. As used herein the term "separate" refers to a process step in which the hydrogenation zone effluent is processed to produce a liquid hydrogenation product and a separate recyclable concentrated active catalyst product. In a conventional slurry hydroprocess the product effluent from the hydrogenation zone will comprise liquid hydrocarbon product in intimate contact with catalyst wherein the weight ratio of catalyst as molybdenum metal to oil will generally range from about 0.0005 to about 0.25, more typically from about 0.001 to about 0.1. Although the catalyst can be separated by conventional means such as filtration, centrifugation, decantation, and the like, a distinguishing feature of the present invention is that the separation is carried out while maintaining substantially the same conditions as those conditions encountered in the hydrogenation zone. In particular, the hydrogen partial pressure of the hydrogenation zone and of the catalyst during separation and recycle typically will be maintained in the range of from at least about 500 psia to about 5000 psia, preferably in the range of from at least about 1000 psia to about 3000 psia, and even more preferably in the range of from at least about 1500 psia to about 2500 psia. In any event the catalyst in the hydrogenation zone and during recycling should be maintained in a reducing atmosphere. Those familiar with the art will recognize that there are numerous ways of accomplishing separation in this fashion. Conventional high pressure separators, or pressurized settling vessels can be used. For instance, one method is to collect product vapors and recycle all liquids from a single product separator. This separation produces a catalyst-free product with minimal operating difficulties and costs. Alternatively, one may wish to increase separator size (or use more than one separator) to allow the catalyst enough time to partially settle out of the liquid phase. Then one would collect a vapor phase product and a liquid phase product from near the top of the liquid layer in the separator, recycling only from the bottom portion of the liquid layer. This method would reduce oil recycle, but liquid product would possibly contain some catalyst. In order to speed the separation and increase product recovery, one may mechanically separate the catalyst from the liquid phase effluent (all under reducing conditions). A hydrocyclone or a centrifuge could be used for this separation.

In most slurry hydroprocessing operations it is desirable to separate substantially all of the catalyst from the liquid hydrocarbon product. Thus, the separation step is typically carried out under conditions which maximize separation to produce a recyclable active catalyst product having a maximum concentration which can be pumped or conveyed to the feed. This is typically in the range of from about 5 weight percent ("wt. %") to about 75 wt. %, preferably in the range of from about 10 wt. % to about 50 wt. %, and even more preferably in the range of from about 15 wt. % to about 35 wt. %. The example accompanying this description of the invention illustrates a preferred embodiment using high pressure separators to effect such separation.

In the second step of the improved process of the present invention at least a portion of the separated active catalyst is recycled to the hydrogenation zone while being maintained under substantially the same conditions as are present in the said hydrogenation zone. In conventional slurry hydroprocessing, all, or nearly all, catalyst recovered from the liquid hydrogenation product is treated to separate a metal value which is in turn recycled to the catalyst preparation stages of the process. For instance, in U.S. Pat. No. 4,557,821 (previously referenced) catalyst and removed metals are recovered as a bottoms product, partially oxidized to convert sulfides to oxides, and recycled to a catalyst precursor reactor. This recycle step takes advantage of the finding that removed metals, such as vanadium, do not deactivate the molybdenum catalyst; in fact, it is reported that an effective circulating catalyst can constitute as much as 85 weight percent of the circulating metals without loss of activity.

However, catalyst recovered from a conventional slurry hydroprocess is either reprocessed to produce fresh catalyst or regenerated, indicating that active catalyst is not directly recycled to the hydrogenation zone. In contrast, according to the present invention, active catalyst is separated and recycled to the hydrogenation zone without additional processing/regeneration. Accordingly, it is a distinguishing feature of the present invention that active catalyst is recycled to the hydrogenation zone without regeneration or further processing to enhance activity.

As noted, the steps detailed above are carried out while maintaining the catalyst under conditions substantially the same as the conditions encountered in the hydrogenation zone in order to avoid rapid deactivation. As those familiar with hydroprocessing will appreciate, slurry hydroprocessing is a hydrogenation process and as such is carried out in the presence of hydrogen, i.e., under hydrogen partial pressure, which is in itself sufficient to establish a reducing atmosphere. Consequently, the requirement that the process steps of the present invention be carried out while maintaining the active catalyst under hydrogenation conditions does not necessitate introducing process variables in addition to those already present. Simply stated, the process of the present invention can be carried out under the process conditions which already exist in order to hydrogenate the liquid feed.

Slurry Hydroprocessing Conditions

The slurry hydroprocessing operations which can suitably be improved by the present invention are well known. For example, U.S. Pat. No. 4,557,821, U.S. Pat. No. 4,710,486; and U.S. Pat. No. 4,762,812 (previously referenced) describe in detail typical slurry hydroprocessing conditions. The full text of each of these patents is therefore incorporated herein by reference. Other suitable slurry hydroprocesses are described in U.S. Pat. No. 4,659,453, issued Apr. 21, 1987 to Kukes et al.; U.S. Pat. No. 4,592,827, issued Jun. 3, 1986 to Galiasso et al.; U.S. Pat. No. 4,285,804, issued on Aug. 25, 1981 to Jacquin et al.; U.S. Pat. No. 4,136,013, issued Jan. 23, 1979 to Moll et al.; U.S. Pat. No. 4,134,825, issued Jan. 16, 1979 to Bearden; and U.S. Pat. No. 3,622,499, issued Nov. 23, 1971 to Stine et al.

In suitable slurry hydroprocessing operations, a slurry catalyst of very fine metal sulfide particles is used to convert heavy hydrocarbon oils, such as crude oils, heavy crude oils, residual oils, as well as refractory heavy distillates such as FCC decanted oils and lubricating oils, to lighter materials under conditions of high pressure and temperature. Typically the slurry catalyst contains molybdenum and nickel sulfides. Typical slurry hydroprocessing operations are carried out under conditions of high temperature and high pressure. Hydrogen partial pressures may range from about 500 psia to about 5000 psia, preferably from about 1000 psia to about 3000 psia, and even more preferably from about 1500 psia to about 2500 psia. In slurry hydroprocesses the relatively high operating pressures and circulating nature of the slurry catalyst are conducive to the use of elevated hydrogenation temperatures in excess of temperatures used in typical fixed bed operations. For example, temperatures may range from about 650° F. to about 1000° F., preferably from about 700° F. to about 900° F. The final catalyst in slurry with feed oil can be charged to the hydroprocessing contact zone without any additions to or removals from the stream. The general reactions conditions of a slurry hydroprocessing operation are listed below:

| | Broad | Preferred | Most Preferred |
|---|---|---|---|
| Temperature, °F. | 650–1000 | 750–950 | 810–870 |
| Partial Pressures, psi | | | |
| Hydrogen (in reactor) | 350–4500 | 600–2000 | 1100–1800 |
| Hydrogen sulfide (in reactor) | 20–400 | 120–250 | 140–200 |
| Hydrogen sulfide (in recycle stream at process pressure) | at least 20 | at least 50 | at least 100 |
| Oil hourly space velocity (LHSV, vol/hr/vol) | 0.2–3 | 0.5–2 | 0.75–1.25 |
| Gas Circulation Rates: | | | |
| Hydrogen to Oil Ratio, SCFB | 500–10,000 | 1500–6000 | 2500–4500 |
| Hydrogen Sulfide to Mo, SCF/lb. | greater than 5. | greater than 30 | greater than 50 |
| Water to Oil Ratio, wt/wt | 0.005–0.25 | 0.01–0.15 | 0.03–0.1 |
| Cat. to Oil Ratio: | | | |
| Mo to Oil Ratio, wt/wt | 0.005–0.25 | 0.0003–0.05 | 0.005–0.02 |

Even under optimal active catalyst recycle conditions, catalyst will eventually deactivate with use. Thus, the process improvement of the present invention can be used to supplement conventional catalyst recovery. Therefore the improved process described above may include a spent catalyst recovery section. For example, U.S. Pat. No. 4,762,812 (previously referenced) describes a spent catalyst recovery section which includes a step for molybdenum separation. In a typical slurry hydroprocess the catalyst to oil ratio based on molybdenum is typically about 0.01. This concentration of molybdenum is costly and so molybdenum must be recovered in order for the process to be economic.

The foregoing discussion is intended to give general guidance relating to the slurry hydroprocessing operations which can be improved by the present invention.

The FIGURE

The FIGURE accompanying this description illustrates a typical slurry hydroprocessing operation comprising a preferred embodiment of the improvement offered by the present invention. In the FIGURE the section circumscribed by a dotted line represents the improvement steps of the present invention.

Turning now to the FIGURE, solid molybdenum trioxide in water ($MoO_3$ is insoluble in water) is introduced into a first catalyst precursor reactor 1 via line 2 and aqueous ammonia (e.g. a twenty percent aqueous solution in water) is introduced via line 3. Aqueous dissolved ammonium molybdate is formed in reactor 1 and passed to a second catalyst precursor reactor 4 through line 5.

Gaseous hydrogen sulfide is added to reactor 5 through line 6 to react with the aqueous ammonium molybdate to form sulfided ammonium salts. The system in reactor 4 is self-stabilizing so that if the solids are filtered out, replacement solids will settle out in the presence or absence of $H_2S$.

This mixture of sulfided compounds in water comprises a catalyst precursor. It passes through line 7 enroute to pretreater 8 where sulfiding reactions involving the precursor catalyst are completed at elevated temperature and pressure. Before entering the pretreater 8, the precursor catalyst in line 7 is first admixed with process feed oil entering through line 9 and with gas containing a $H_2/H_2O$ mixture entering through line 10. These admixed components may, but not necessarily, comprise the entire feed components required by the process. The admixture passes through line 11 to pretreater 8.

The pretreater typically comprises multiple stages operated at a temperature below the temperature of the hydrogenation zone 12. In the pretreater 8 the precursor catalyst under goes further reaction to form catalytically active $MoS_2$. Thus, the catalyst preparation is substantially completed in the pretreater 8.

The catalyst leaving the pretreater s through line 13 is the final catalyst and enters the hydrogenation zone 12 in the form of filterable slurry solids.

Effluent from the hydrogenation zone 12 flows through line 14 to high pressure separator 15. Process gases are withdrawn from the separator 15 through overhead line 16. The process gases are cooled in Exchanger 44 to condense hydrocarbons which are recovered from the bottom of Knockout Drum 45 through line 46. Hydrogen is recycled for admixture with the process feed oil through line 47. Any required make-up $H_2$ or $H_2S$ can be added through lines 17 and 18, respectively.

Sufficient residence time may be allowed in separator 15 for catalyst to begin settling to the bottom of the separator. A relatively catalyst-free oil phase can be drawn off near the top of the separator through line 23*a*. The catalyst and oil are removed from separator 15 through draw-off line 19, and are optionally fed to a second high pressure separator 20 which operates as a second high pressure settler. A relatively catalyst-free oil phase can be drawn off near the top of separator 20 through line 23*b*. A lower oil layer comprising active catalyst is withdrawn through downspout and draw-off line 21 and recycled to the hydrogenation zone 12. In accordance with the present invention, the conditions of separators 15 and 20 are maintained at substantially the same hydrogen partial pressure as conditions in hydrogenation zone 12. As can be seen in the FIGURE, this is accomplished by maintaining the active catalyst within the hydrogen loop. Relatively catalyst-free oil from Knockout Drum 45, separator 15 and separator 20 are combined and passed through a series of pressure let-down valves in line 23, and are fed to atmospheric fractionation tower 24 from which various distillate product fractions are removed through a plurality of lines 25, 26, and 27 and from which a residue fraction is removed bottoms through line 28. A portion of residue fraction may be recycled for further conversion via line 29. Most or all of the atmospheric residue product is passed through line 30 to vacuum distillation tower 31 from which distillate product fractions are withdrawn through a plurality of lines 32, 33, and 34 and a residue fraction is removed through bottoms line 35.

A portion of the vacuum bottoms may be recycled to pretreater 8 through line 36, if desired, while most or all of the bottoms fraction passes through line 37 to solvent extractor 38. A suitable solvent is passed through line 39 to solvent extractor 38 to extract oil from deactivated catalyst and extracted metals which were not separated in separator 15 and separator 20. In extractor 38 an upper oil phase is separated from a lower sludge phase. The oil phase is removed via line 40. The bottoms phase comprising deactivated catalyst and removed metals is removed via line 41 and is subject to catalyst reprocessing and metals recovery 42. Metal oxides are frequently produced during the catalyst reprocessing and can be fed via line 43 to the first catalyst precursor reactor 1.

There are numerous variations on the embodiment of the present invention illustrated in the FIGURE which are possible in light of the teachings supporting the present invention. It is therefore understood that within the scope of the following claims, the invention may be practiced otherwise than as specifically described or illustrated herein.

What is claimed is:

1. In an improved catalytic slurry hydroprocess having at least a hydrogenation zone the improvement which comprises the following steps and conditions:

(1) concentrating at least a portion of recyclable active catalyst in the liquid hydrogenation product eluted from said hydrogenation zone of said hydroprocess;

(2) separating at least a portion of said concentrated catalyst from the liquid hydrogenation product; and (3) recycling at least a portion of said separated active catalyst to said hydrogenation zone;

wherein said steps are carried out while maintaining said active catalyst under conditions substantially the same as those encountered in said hydrogenation zone.

2. A process according to claim 1 wherein the hydrogen partial pressure in the hydrogenation zone is at least 100 psia, and said improvement steps are carried out at a hydrogen partial pressure of about 100 psia.

3. A process according to claim 2 wherein the hydrogen partial pressure in the hydrogenation zone is in the range of from at least about 500 psia to about 5000 psia, and said improvement steps are carried out at a hydrogen partial pressure in the range of from about 500 psia to about 5000 psia.

4. A process according to claim 3 wherein the hydrogen partial pressure in the hydrogenation zone is in the range of from at least about 1000 psia to about 3000 psia, and said improvement steps are carried out at a hydrogen partial pressure in the range of from about 1000 psia to about 3000 psia.

5. A process according to claim 4 wherein the hydrogen partial pressure in the hydrogenation zone is in the range of from at least about 1500 psia to about 2500 psia, and said improvement steps are carried out at a hydrogen partial pressure in the range of from about 1500 psia to about 2500 psia.

6. A process according to claim 1 wherein said improvement steps are carried out within a hydrogen loop of said hydroprocess.

7. A process according to claim 1 wherein said step (1) is carried out in one or more high pressure separators.

8. A process according to claim 1 wherein the hydroprocess comprises introducing feed oil, hydrogen, water, hydrogen sulfide and hydrogenation catalyst to a hydroprocessing Zone, the weight ratio of water to oil being between about 0.005 and about 0.25, the partial pressure of hydrogen sulfide being between about 20 psia and about 400 psia, the hydrogen partial pressure being between about 350 psia and about 4500 psia, the temperature being between about 650° F. and about 1000° F., said water being at least partially in the vapor phase, said hydrogenation catalyst comprising sulfided molybdenum which is present in said hydroprocess in the molybdenum as metal to oil weight ratio of from about 0.0005 to about 0.25 with said catalyst having been prepared by reacting aqueous ammonia and molybdenum oxide with a weight ratio of ammonia to molybdenum as metal of from about 0.1 to about 0.6 to form aqueous ammonium molybdate, reacting said aqueous ammonium molybdate with hydrogen sulfide to form a precursor slurry, mixing said precursor slurry with feed oil, hydrogen and hydrogen sulfide and heating said mixture at a pressure between about 500 psia and about 5000 psia so that it is within the temperature range of about 150° F. to about 350° F. for a duration of from about 0.05 to about 0.5 hours, further heating said mixture so that it is within the temperature range of from about 350° F. to about 750° F. for a time duration of from about 0.05 to about 2 hours, and said hydroprocess to include recycling to said hydroprocessing zone a hydrogen-hydrogen sulfide stream separated from the hydroprocessing zone effluent wherein the partial pressure of hydrogen sulfide is at least about 20 psia so that the circulation of hydrogen sulfide is greater than about 5 standard cubic feet per pound of molybdenum as metal and the hydrogen circulation rate is between about 500 and about 10,000 standard cubic feet per barrel.

9. A process according to claim 1 wherein substantially all active catalyst is separated and recycled.

10. A process according to claim 1 wherein the concentration of recyclable active catalyst is from about 5 wt. % to about 75 wt. % expressed as molybdenum metal to oil.

11. A process according to claim 10 wherein said concentration is from about 10 wt. % to about 50 wt. %.

12. A process according to claim 11 wherein said concentration is from about 15 wt. % to about 35 wt. %.

13. A process according to claim 1 wherein the improvement steps are carried out in a reducing atmosphere.

* * * * *